United States Patent [19]

North et al.

[11] Patent Number: 4,482,295

[45] Date of Patent: Nov. 13, 1984

[54] TURBINE AIRFOIL VANE STRUCTURE

[75] Inventors: William E. North, Concord Township, Delaware County, Pa.; Thomas M. Szewczuk, Claymont, Del.

[73] Assignee: Westinghouse Electric Corp., Pittsburgh, Pa.

[21] Appl. No.: 366,625

[22] Filed: Apr. 8, 1982

[51] Int. Cl.[3] ..... F01D 5/08

[52] U.S. Cl. ..... 416/96 A; 416/97 R; 415/115

[58] Field of Search ..... 415/115; 416/96 A, 96 R, 416/97 R

[56] References Cited

U.S. PATENT DOCUMENTS 3,540,810 11/1970 Kercher ..... 415/115 X
3,715,170 2/1973 Savage et al. ..... 416/97
4,252,501 2/1981 Peill ..... 416/97 R X
4,257,734 3/1981 Guy et al. ..... 415/115
4,297,077 10/1981 Durgin et al. ..... 416/97 R

*Primary Examiner*—Philip R. Coe
*Assistant Examiner*—Frankie L. Stinson
*Attorney, Agent, or Firm*—E. C. Arenz

[57] ABSTRACT

A hollow stator vane for a turbine is provided with separate forward and aft inserts 26 and 32 with the forward insert providing impingement cooling of the vane walls while the aft insert is closely fitted into the vane internal cavity to provide closely defined channel widths between the insert and facing walls of the vane, the aft insert also including means functioning during operation to ensure the maintenance of the closely defined channel widths, the coolant air admitted to the inserts functioning first for impingement cooling, then channel flow cooling along the aft insert, and then channel flow cooling of the trailing edge 18 through an exit slot.

4 Claims, 4 Drawing Figures

TURBINE AIRFOIL VANE STRUCTURE

BACKGROUND OF THE INVENTION

1. Field of the Invention:

This invention pertains to the art of turbine airfoil vanes having a structure to promote their cooling.

2. Description of the Prior Art:

In the turbine art, it is well known that different stages of the stator vanes require different levels of cooling, with the vane structure with which this invention is concerned being of a character and in a stage calling for what those knowledgeable in the art would consider to be a low to moderate level of cooling. It is also known by those skilled in the art that with a given vane, the degree of cooling required at different locations on the vane may differ. Thus the leading edge region of the vane may have a relatively high heat load while downstream along the vane the heat load may be significantly lower.

It is the aim of the invention to provide a vane structure providing cooling techniques which allow a high degree of tailoring of the cooling design while also reasonably maximizing the thermal efficiency of the cooling system. It is to be understood that thermal efficiency is a term used to measure the coolant heat-up against the level of cooling achieved. In that sense, high thermal efficiencies imply relatively low quantities of cooling flow which leads to improved turbine performance. Thus, the structure of the invention is intended to provide cooling techniques which allow the maximum coolant heat-up to produce the maximum thermal efficiency.

SUMMARY OF THE INVENTION

In accordance with the invention, a hollow, airfoil-shaped turbine vane having an internal cavity is provided with a forward, hollow insert, and a separate, hollow aft insert, both of which receive cooling air, with the forward insert functioning as an impingement insert in that a multiplicity of impingement ports are provided through which the cooling air is jetted against the leading edge wall and the forward portion of the suction and pressure sidewalls of the vane, the aft insert having impingements ports limited to the forward portion thereof and oriented to direct air in a generally forward direction within the cavity. The aft insert includes spacer means on its exterior faces in a close interference fit with the facing walls of the vane to promote a closelydefined width channel between the aft insert and the facing walls so that the cooling of the vane walls facing the aft insert is substantially wholly by a channel flow effect. The vane walls are imperforate except for a trailing edge exit air slot so that all of the impingement cooling air from the forward insert and the aft insert is used for channel flow cooling along the sides of the aft insert as well as channel flow cooling through the air exit in the trailing edge.

DESCRIPTION OF THE PREFERRED EMBODIMENT

Figure 1:
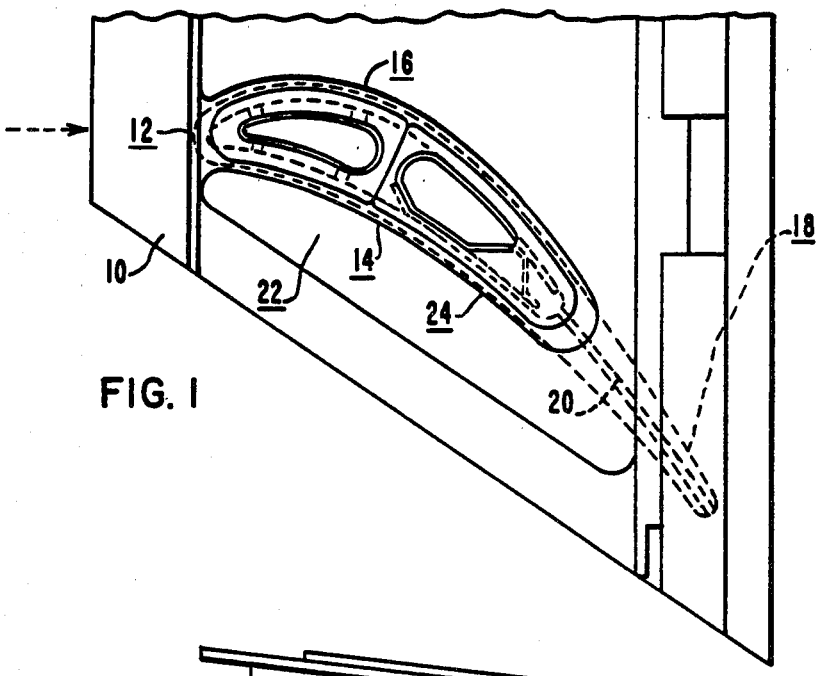
FIG. 1 is a top plan view of one stator vane incorporating the invention.
Figure 4:
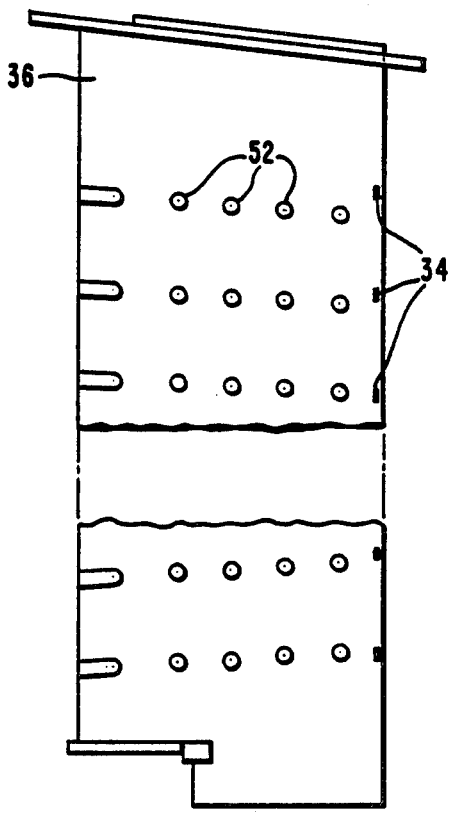
FIG. 4 is a broken, side view of the aft insert.

Referring to FIG. 1, the single vane shown is connected at its radially outer end to outer shroud structure 10 in a manner well known to those skilled in the art.

The hollow vane is defined by the leading edge section generally designated 12, a concave side wall generally designated 14, a convex side wall generally designated 16, the downstream portions of these opposite side walls defining a trailing edge portion generally designated 18 and provided with a slot 20 therein. The direction of the hot gas past the vane is as indicated by the dashed line arrow in FIG. 1 so that it will be apparent that the concave side 14 is the pressure side of the vane while the convex side 16 is the suction side. The internal cavity defined by the vane is considered for purposes herein to be divided into a forward portion generally designated 22 and an aft portion generally designated 24.

Figure 2:
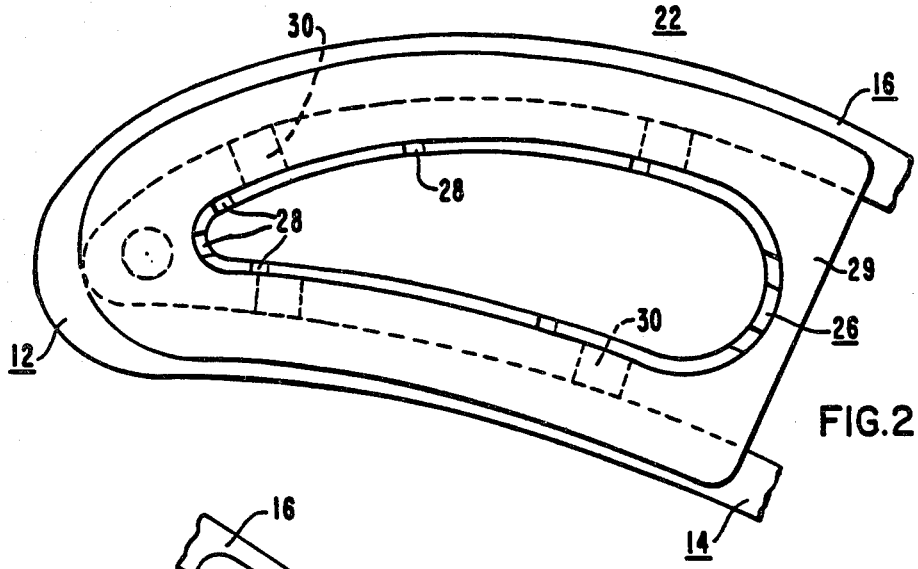
FIG. 2 is a partly broken top plan view of the forward portion of the vane containing the forward insert.

Turning to FIG. 2, the forward portion 22 of the vane and its nose 12 are subject to higher heat loads than the farther downstream portions of the vane. Accordingly, a forward hollow insert 26 is installed in the forward portion of the vane and is provided with a multiplicity of impingement ports 28 arrayed around the outline of the insert, and also extending in rows from end to end of the insert. In the illustration, three ports are shown as being generally directed toward the nose of the vane while two are directed toward the suction side, one toward the pressure side, and two toward the rear portion of the vane. Coolant air is directed into the forward insert through the opening in the top plate 29 and jets through these ports to provide cooling of the vane portions facing the ports at the sides and front. The insert 26 is spaced from the vane walls by a series of spacers 30 at strategic locations on the walls of the insert. As noted the nose and leading portion of the vane are subject to a relatively high heat load. Thus, in accordance with the invention, the forward insert is designed solely for providing impingement cooling as contrasted to channel effect cooling. While impingement cooling functions well in high heat load regions, in low heat load regions the impingement ports should be spaced far apart for efficiency of cooling air usage. However, the spacing of the ports far apart causes undesirable temperature gradients in the vane walls.

Figure 3:
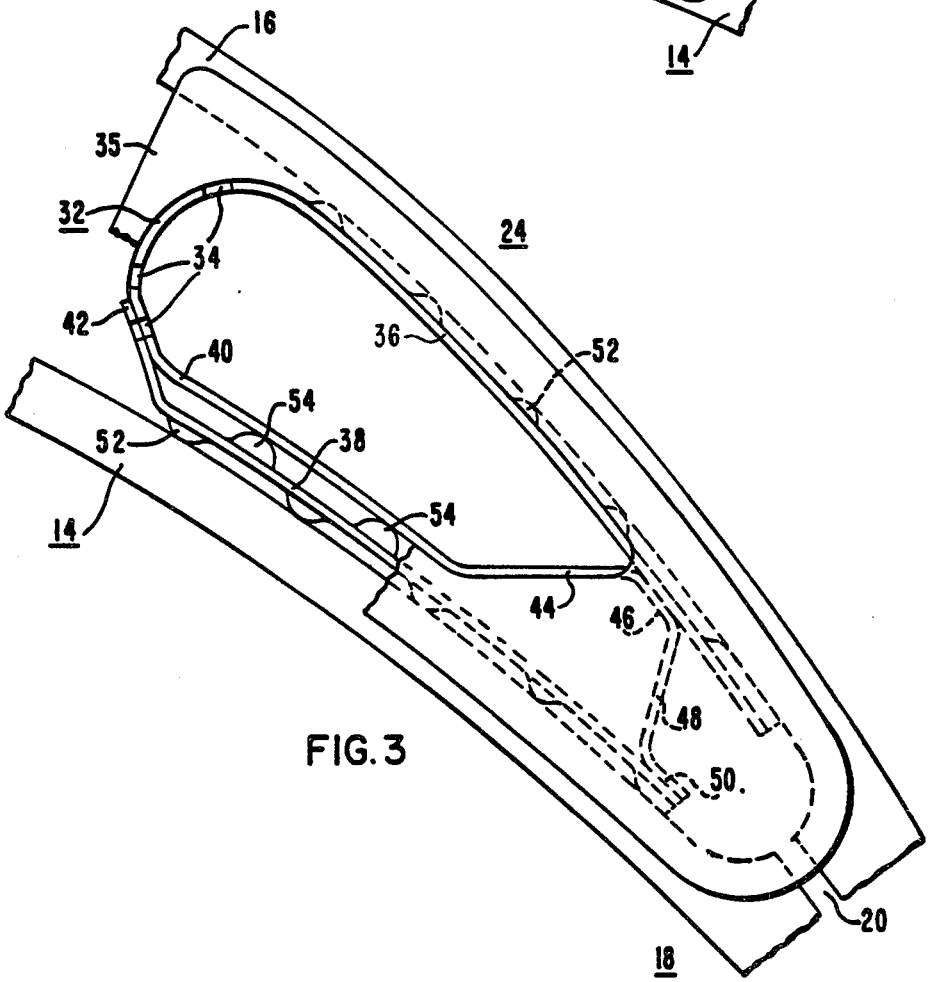
FIG. 3 is a partly broken top plan view of the aft portion of the vane containing the aft insert.

Thus, further in accordance with the invention, substantially all of the cooling effect of the vane walls facing the aft insert is accomplished through channel flow cooling as will be explained in connection with FIG. 3. The separate, aft insert generally designated 32 is located in the internal cavity spaced between the forward insert 26 and the trailing edge slot 20. The aft insert includes a number of impingement ports 34 located in the forward or nose portion of the insert, in rows extending between the opposite ends of the insert, with all of these ports being oriented to direct cooling air received by the aft insert internally thereof through the opening in top plate 35 in a generally forward direction.

The aft insert 32 is formed with a single wall 36 along its suction side while the pressure side includes a double wall portion comprising outer wall 38 and inner wall 40. The inner wall is secured as by brazing to the forward end of the outer wall 38 at the location 42 as shown in FIG. 3, with the inner wall having an oblique portion 44 extending to the suction side wall 36 at location 46 where the walls are brazed together, and then extending back obliquely in portion 48 to the outer pressure side wall 38 at the rear end thereof indicated at numeral 50. The inner wall 40 is connected at each of its contact points with other walls as by brazing. Both the suction side wall 36 and the pressure side outer wall 38 have a number of dimples 52 embossed in an outward direction in the walls. In addition, the outer pressure side wall 38 has inwardly embossed dimples 54 in that part of its forward portion which is closely spaced to the inner wall 40.

The aft insert construction described results in a structure which, upon insertion into the vane cavity, rsults in an interference fit between the dimples and the facing walls of the vane so that a closely-defined width channel is formed on both sides of the insert between its walls and the facing walls of the vane. The channel width spacing of the aft insert is significantly more important than the spacing of the forward insert, which can be "looser" since the forward cooling is by impingement. The ratio of the spacings currently preferred is in the order of about 2½ to 1 of the forward insert relative to the aft.

The close control of the channel width at the sides of the aft insert is further augmented by the structural arrangement of the double wall portion in which the outer wall functions as an effectively spring-loaded "flapper" on the pressure side of the insert. During operation, internal pressure in the insert resulting from cooling air being injected into the insert causes a flexing of the inner wall 40 which, through the dimples 54, functions to hold the outer wall 38 tightly against the facing vane wall and with the opposite wall 36 held tightly in its closely spaced relation with the suction side vane wall.

In operation, coolant air is introduced into both the forward insert 26 and into the aft insert 32 with the ratio of air admitted to these inserts being approximately 2:1 in favor of the forward insert. The air exits through the impingement ports 28 of the forward insert to provide impingement cooling in the high heat load region. The air admitted to the aft insert exits through the impingement ports 34 and joins with that air from the forward insert and flows along the opposite sides of the aft insert to provide the channel flow cooling in this lower heat load region, with all of this air then exiting through the air exit slot 20 to provide cooling of the trailing edge through the channel flow effect. As a result, it will be seen that the cooling flow in the subject structure is effectively used three times through impingement, channel flow cooling along the aft insert, and channel flow cooling of the trailing edge.

A separate insert arrangement, that is, the provision of a separate forward insert and an aft insert, is not new in itself as evidenced by U.S. Pat. No. 4,297,007. However, the provision of the separate inserts solves an assembly problem in that if a one-piece insert were to be provided in place of the two separate inserts, the shape of the forward portion of the vane, which may in a sense be considered to be twisted with respect to its spanwise development, would prevent the insertion of a single insert occupying the internal cavity.

It is also to be noted that the interior of the cavity in the region between the two inserts is unobstructed, and that the nose and pressure and suction walls of the vane are imperforate so that all of the coolant air entering the inserts is ultimately used for channel flow cooling of the aft insert, and channel flow cooling of the trailing edge.

We claim:

1. An airfoil-shaped, hollow, turbine vane having a leading edge wall, and a trailing edge portion with an exit air slot therein, and pressure and suction sidewalls and an internal cavity in communication with said exit air slot;

an impingement air insert located in the forward portion of said cavity and including a multiplicity of impingement ports through which cooling air received by said forward insert is jetted against said leading edge wall and said suction and pressure sidewalls;

a separate, aft insert in said internal cavity space betwen said forward insert and said trailing edge slot, said aft insert including spacer means on the exterior faces thereof in an interference fit with the facing walls of said vane to promote a closely-defined width channel between said aft insert and the facing walls, said aft insert including means operative to hold the walls of said aft insert outwardly towards said vane walls to maintain said closely-defined width in operation, said aft insert including a plurality of impingement ports located in the forward portion thereof and oriented to direct air received by said aft insert in a generally forward direction so that cooling of the suction and pressure sidewalls facing said aft insert is substantially wholly by a channel flow effect, the interior of said vane cavity between said inserts being unobstructed, and the leading edge wall and the suction and pressure sidewalls being imperforate so that all of the impingement cooling air from said forward insert and said aft insert is converted to channel flow cooling air along the sides of said aft insert;

said aft insert includes a double wall portion in the forward portion on the pressure side, the inner one of said double walls extending obliquely to the suction side wall in the rear portion of said insert, with spacer means between said forward double wall portion so that with the admission of air into said aft insert said forward inner wall portion of the insert flexes toward the pressure side to thereby maintain a closely dimensioned space for channel flow cooling at the suction side.

2. An airfoil-shaped, hollow, turbine vane having a leading edge wall, and a trailing edge portion with an exit air slot therein, and pressure and suction sidewalls and an internal cavity in communication with said exit air slot;

an impingement air insert located in the forward portion of said cavity and including a multiplicity of impingement ports through which cooling air received by said forward insert is jetted against said leading edge wall and said suction and pressure sidewalls;

a separate, aft insert in said internal cavity space between said forward insert and said trailing edge slot, said aft insert including spacer means on the exterior faces thereof in an interference fit with the facing walls of said vane to promote a closely-defined width channel between said aft insert and the facing walls, the width of said closely-defined-width channel being substantially narrower than the spacing between the suction and pressure side walls and the facing walls of said forward insert, said aft insert including means operative to hold the walls of said aft insert outwardly towards said vane walls to maintain said closely defined width in operation, said aft insert including a plurality of impingement ports located in the forward portion thereof only and oriented to direct air received by said aft insert in a generally forward direction so that cooling of the suction and pressure sidewalls facing said aft insert is substantially wholly by a channel flow effect, the interior of said vane cavity between said inserts being unobstructed, and the leading edge wall and the suction and pressure sidewalls being imperforate so that all of the impingement cooling air from said forward insert and said aft insert is converted to channel flow cooling air along the sides of said aft insert.

3. A vane according to claim 2 wherein:

the spacing between the suction and pressure side wall with respect to the facing walls of the forward insert is in the order of at least twice the spacing between the suction and pressure side walls of the vane and the facing walls of the aft insert.

4. The vane according to claim 2 wherein:

the impingement air admitted to said forward insert is in the order of at least twice that of the impingement air admitted into said aft insert.

* * * * *